US010019928B2

(12) United States Patent
He et al.

(10) Patent No.: US 10,019,928 B2
(45) Date of Patent: Jul. 10, 2018

(54) METHOD AND DEVICE FOR OBTAINING MURA COMPENSATION VALUE, AND DISPLAY PANEL

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zongze He, Beijing (CN); Jieqiong Wang, Beijing (CN); Dan Su, Beijing (CN); Shuo Li, Beijing (CN); Jianguang Yang, Beijing (CN); Zhipeng Feng, Beijing (CN); Liang Zhang, Beijing (CN)

(73) Assignees: BOE TECHNOLOGY GROUPO CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/536,087

(22) PCT Filed: Aug. 11, 2016

(86) PCT No.: PCT/CN2016/094614
§ 371 (c)(1),
(2) Date: Jun. 14, 2017

(87) PCT Pub. No.: WO2017/173756
PCT Pub. Date: Oct. 12, 2017

(65) Prior Publication Data

US 2018/0122282 A1 May 3, 2018

(30) Foreign Application Priority Data

Apr. 5, 2016 (CN) ..... 2016 1 0206534

(51) Int. Cl.
*G09G 3/20* (2006.01)

(52) U.S. Cl.
CPC ..... *G09G 3/2003* (2013.01); *G09G 3/2088* (2013.01); *G09G 2320/0242* (2013.01); *G09G 2320/0276* (2013.01)

(58) Field of Classification Search
None
See application file for complete search history.

(56) References Cited

U.S. PATENT DOCUMENTS

2003/0137606 A1* 7/2003 Rumreich ..... G09G 3/20 348/675
2007/0091042 A1* 4/2007 Chung ..... G09G 3/3648 345/88

(Continued)

FOREIGN PATENT DOCUMENTS

CN 103680449 A 3/2014
CN 104992657 A 10/2015

(Continued)

OTHER PUBLICATIONS

International Search Report and Written Opinion dated Jan. 11, 2017, for corresponding PCT Application No. PCT/CN2016/094614.

(Continued)

*Primary Examiner* — Xin Sheng
(74) *Attorney, Agent, or Firm* — Kinney & Lange, P.A.

(57) ABSTRACT

The present disclosure provides a method for obtaining a mura compensation value, a device for obtaining a mura compensation value and a display panel. The method includes: obtaining an image of a detection picture displayed on a display panel, extracting display data matrices of three primary colors, obtaining first correction matrices of the three primary colors, obtaining position coordinates of extreme points of the first correction matrices of the three (Continued)

primary colors, obtaining second correction matrices and a third correction matrix group of the three primary colors, obtaining compensation matrices from the third correction matrices as mura compensation values of the display panel.

20 Claims, 3 Drawing Sheets

(56) References Cited

U.S. PATENT DOCUMENTS

| | | | | |
|---|---|---|---|---|
| 2009/0135211 | A1 | 5/2009 | Wang et al. | |
| 2010/0013750 | A1 | 1/2010 | Kerofsky et al. | |
| 2010/0110098 | A1* | 5/2010 | Wang | G09G 3/3413 345/589 |
| 2018/0047368 | A1* | 2/2018 | Luo | G09G 5/10 |

FOREIGN PATENT DOCUMENTS

| | | | |
|---|---|---|---|
| CN | 105070247 | A | 11/2015 |
| CN | 105654891 | A | 6/2016 |
| TW | 200923873 | A | 6/2009 |

OTHER PUBLICATIONS

First Chinese Office Action, for Chinese Patent Application No. 201610206534.9, dated Dec. 18, 2017, 9 pages.

* cited by examiner

METHOD AND DEVICE FOR OBTAINING MURA COMPENSATION VALUE, AND DISPLAY PANEL

CROSS-REFERENCE TO RELATED APPLICATION

This application claims priority of Chinese Patent Application No. 201610206534.9 filed on Apr. 5, 2016, entitled "METHOD AND DEVICE FOR OBTAINING MURA COMPENSATION VALUE, AND DISPLAY PANEL", in the State Intellectual Property Office of China, the disclosure of which is incorporated in entirety herein by reference.

BACKGROUND

Technical Field

Embodiments of the present disclosure relate to a field of display technology, and more particularly, to a method for obtaining a mura compensation value, a device for obtaining the mura compensation value, and a display panel.

Description of the Related Art

Term "mura" refers to a phenomenon of non-uniform display about a display panel, which is caused by factors of manufacturing process level, raw material purity and so on and is a prevalent technical problem in the field of display technology. As video display technology rapidly develops, a display technique being large-sized, having ultra-high resolution and ultra-narrow bezel has become one of main focuses for competing with each other among various panel manufacturers. However, process control for the display panel is more and more difficult as the size thereof increases, and control deviation of the manufacturing process is likely to cause a poor image uniformity, thereby generating the mura phenomenon. Such phenomenon will directly result in a reduced yield of the display panel and in turn make the manufacturers suffer losses. Although the probability of occurrence of the mura phenomenon can be reduced by improving the process level, improving the raw material purity or the like, it is too difficult to achieve this goal in a short time. Furthermore, after all the manufacturing processes have been completed, physical properties of the display panel has been determined, it is impossible to solve the mura problem by improving the process level or improving the raw material purity. As for the manufactured display panel, the mura phenomenon may be alleviated by compensating display data of pixels, but it is the key point of the problem how to obtain the compensation data. The existing way for obtaining the compensation data in the prior art presents disadvantages such as a low compensation precision and a large data processing amount. Therefore, it is one of the problems needed to be solved in the art how to obtain a method with a high compensation precision and a small data processing amount.

SUMMARY

In order to solve the above or other problems in the prior art, the present disclosure provides a method for obtaining a mura compensation value, a device for obtaining a mura compensation value, and a display panel.

In detail, there is provided in the present disclosure a method for obtaining a mura compensation value, comprising steps of:

step A: obtaining an image of a detection picture displayed on a display panel, and extracting display data matrices of three primary colors from the image of the detection picture;

step B: constructing a standard matrix, and subtracting the standard matrix from the display data matrices of the three primary colors to obtain first correction matrices of the three primary colors, so as to correct the display data matrices of the three primary colors;

step C: obtaining position coordinates of extreme points of the first correction matrices of the three primary colors, wherein the first correction matrix of each primary color has one or more position coordinates of the extreme points;

step D: obtaining second correction matrices of the three primary colors from the first correction matrices of the three primary colors, so as to further correct the first correction matrices of the three primary colors;

step E: extracting a third correction matrix of each primary color from the second correction matrix of the primary color based on position coordinates of an extreme point of the first correction matrix of the each primary color, and forming a third correction matrix group of the primary color from third correction matrices extracted based on the position coordinates of all extreme points of the first correction matrix of the primary color; and step F: obtaining a compensation matrix of each primary color from one third correction matrix in the third correction matrix group of the each primary color; forming a compensation matrix group of the primary color from the compensation matrices of the primary color obtained from all the third correction matrices in the third correction matrix group of the primary color, wherein elements of the compensation matrices of the primary color are mura compensation values of the primary color of the display panel.

There is further provided in the present disclosure a device for obtaining a mura compensation value, comprising:

an image acquisition and three-primary-colors display data matrix extraction device, configured for obtaining an image of a detection picture displayed on a display panel and extracting display data matrices of three primary colors from the image of the detection picture;

a first correction matrix obtaining device, configured for constructing a standard matrix and subtracting the standard matrix from the display data matrices of the three primary colors to obtain first correction matrices of the three primary colors, so as to correct the display data matrices of the three primary colors;

an extreme point position coordinate obtaining device, configured for obtaining position coordinates of extreme points of the first correction matrices of the three primary colors, wherein the first correction matrix of each primary color has one or more position coordinates of extreme points;

a second correction matrix obtaining device, configured for obtaining second correction matrices of the three primary colors from the first correction matrices of the three primary colors, so as to further correct the first correction matrices of the three primary colors;

a third correction matrix extraction device, configured for extracting a third correction matrix of each primary color from the second correction matrix of the each primary color based on position coordinates of an extreme point of the first correction matrix of the each primary color and forming a third correction matrix group of the primary color from third correction matrices extracted based on the position coordinates of all extreme points of the first correction matrix of the primary color; and a compensation matrix obtaining device, configured for obtaining a compensation matrix of each primary color from one third correction matrix in the third correction matrix group of the each primary color and forming a compensation matrix group of the primary color from the compensation matrices of the primary color obtained from all the third correction matrices in the third correction matrix group of the primary color, wherein elements of the compensation matrices of the primary color are mura compensation values of the primary color of the display panel.

There is further provided in the present disclosure a display panel, comprising a driver and a storage device, wherein the compensation matrix group obtained by the device for obtaining the mura compensation value is stored in the storage device, and the driver is configured to perform mura compensation to the display panel using the compensation matrices in the compensation matrix group.

DETAILED DESCRIPTION OF PREFERRED EMBODIMENTS

In order to make the objects, technical solutions and advantages of the present disclosure more clear, the present disclosure will now be described in more detail in connection with the specific embodiments, with reference to the accompanying drawings.

Figure 1:
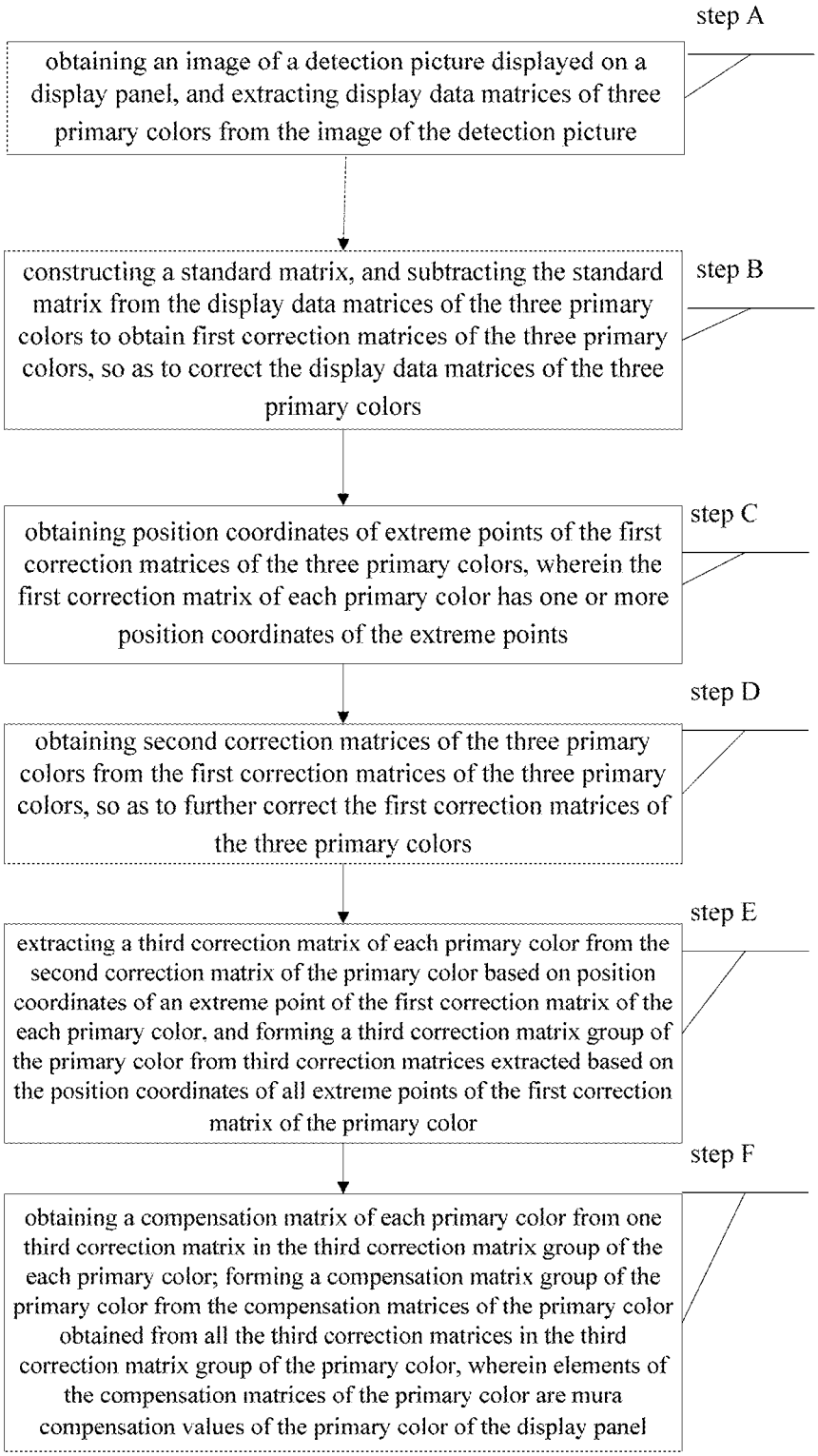
FIG. 1 is a flow chart of a method for obtaining a mura compensation value according to a first embodiment of the present disclosure.

FIG. 1 is a flow chart of a method for obtaining a mura compensation value according to a first embodiment of the present disclosure. The method for obtaining the mura compensation value according to the first embodiment of the present disclosure comprises:

Step A: acquiring or obtaining an image of a detection picture displayed on a display panel, and extracting a display data matrix of three primary colors from the image of the detection picture.

The display panel to which the first embodiment of the present disclosure is directed is for example, but not limited to, a plasma display panel, a liquid crystal display panel (LCD), a light emitting diode display panel (LED), or an organic light emitting diode display panel (OLED). The display panel has a resolution of M×N (M and N are positive integers), and each of pixels displays on the basis of display data of RGB three primary colors. The display data are optionally grayscale values of the pixels, luminance values of the pixels, or driving voltage values of the pixels.

The step A specifically includes steps of:

Sub-step A1: selecting the grayscale values as the display data, and a display panel with a resolution of M×N to display the detection picture, wherein the grayscale values of RGB three primary colors of all the pixels of the detection picture are grayscale values to be set, i.e., the detection picture is a picture of pure color gray scale.

Figure 2:
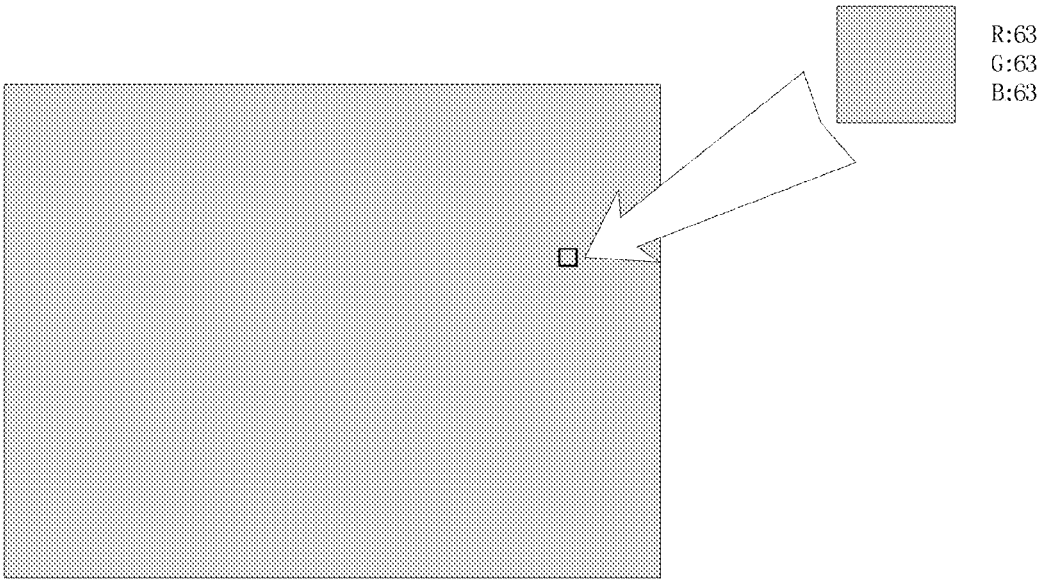
FIG. 2 is a detection picture with a pure color gray scale value of 63 in an ideal circumstance.
Figure 3:
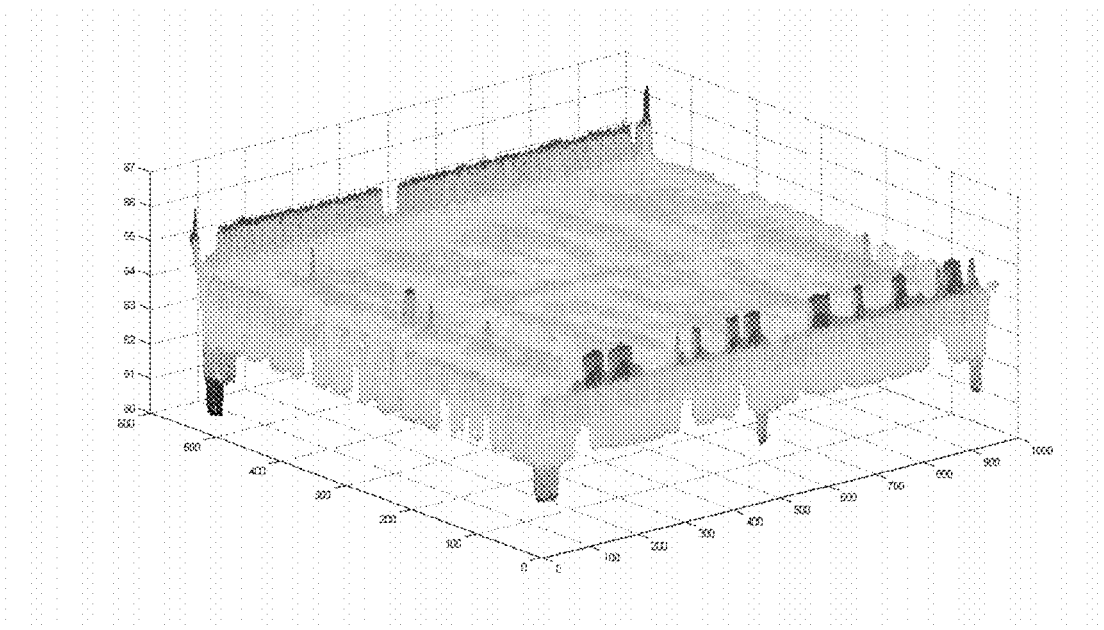
FIG. 3 is a plot showing derivations of actual grayscale values of RGB three primary colors of pixels of a detection picture.

For example, as shown in FIG. 2, R primary color gray values, G primary color gray values and B primary color gray values of all the pixels of the detection picture are 63. In an ideal circumstance, the detection picture shall be a picture with a pure color gray scale value of 63. But due to factors of manufacturing process level, raw material purity and so on, a non-uniform image and thereby the mura phenomenon are generated, there are derivations in actual grayscale values of the RGB three primary colors of the pixels of the detection picture. As shown in FIG. 3, actual R primary color gray values, G primary color gray values and B primary color gray values of the pixels of the detection picture are greater than or less than 63.

Sub-step A2: photographing the detection picture to obtain the image of the detection picture.

Sub-step A3: extracting gray detection values of the RGB three primary colors for each pixel of the image of the detection picture, forming grayscale value matrices $R_0$, $G_0$ and $B_0$ of the three primary colors from the gray detection values of R primary color, the gray detection values of G primary color, the gray detection values of B primary color for all the pixels, respectively.

Specifically, all the grayscale value matrices $R_0$, $G_0$ and $B_0$ of the three primary colors are a two dimensional matrix of M×N, each element of $R_0$ corresponds to one pixel of the image of the detection picture, the value of the element corresponds to the gray detection value of the R primary color of the pixel. Similarly, each element of $G_0$ or $B_0$ also corresponds to one pixel of the image of the detection picture, and the value of such element also corresponds to the gray detection value of the G primary color or the B primary color of the pixel.

Step B: constructing a standard matrix, and subtracting the standard matrix from the display data matrices of the three primary colors to obtain first correction matrices of the three primary colors, so as to correct the display data matrices of the three primary colors.

The step B specifically includes a step of constructing a two dimensional standard matrix of M×N, element values of which are the set grayscale values in the sub-step A1, and respectively subtracting the two dimensional standard matrix from the grayscale value matrices $R_0$, $G_0$ and $B_0$ of the three primary colors to obtain the first correction matrices $R_1$, $G_1$ and $B_1$ of the three primary colors.

Step C: obtaining position coordinates of extreme points of the first correction matrices of the three primary colors, wherein the first correction matrix of each primary color has one or more position coordinates of extreme points.

The step C specifically includes steps of:

Sub-step C1: finding out peak points of the first correction matrices $R_1$, $G_1$ and $B_1$ of the three primary colors, wherein the peak points are local maximum elements and local minimum elements in the first correction matrices $R_1$, $G_1$ and $B_1$ of the three primary colors;

Sub-step C2: selecting the peak points of the first correction matrices $R_1$, $G_1$ and $B_1$ of the three primary colors, absolute values of which are greater than a threshold value, as the extreme points of the first correction matrices $R_1$, $G_1$ and $B_1$, and obtaining the position coordinates of extreme points of the first correction matrices $R_1$, $G_1$ and $B_1$ of the three primary colors.

The step C2 specifically includes steps of:

setting a first threshold value, and selecting the peak points of the first correction matrix $R_1$ of the R primary color, the absolute values of which are greater than the first threshold value, as the extreme points of the first correction matrix $R_1$ of the R primary color, to obtain the position coordinates $(r_m, r_n)_i$ of extreme points of the first correction matrix $R_1$ of the R primary color, wherein i is the i-th extreme point, $1 \le i < M \times N$, $r_m$, $r_n$ are position coordinate values of the i-th extreme point, $1 \le m \le M$, $1 \le n \le N$;

setting a second threshold value, and selecting the peak points of the first correction matrix $G_1$ of the G primary color, the absolute values of which are greater than the second threshold value, as the extreme points of the first correction matrix $G_1$ of the G primary color, to obtain the position coordinates $(g_m, g_n)_j$ of extreme points of the first correction matrix $G_1$ of the G primary color, wherein j is the j-th extreme point, $1 \le j < M \times N$, $g_m$, $g_n$ are position coordinate values of the j-th extreme point, $1 \le m \le M$, $1 \le n \le N$;

setting a third threshold value, and selecting the peak points of the first correction matrix $B_1$ of the B primary color, the absolute values of which are greater than the third threshold value, as the extreme points of the first correction matrix $B_1$ of the B primary color, to obtain the position coordinates $(b_m, b_n)_k$ of extreme points of the first correction matrix $B_1$ of the B primary color, wherein k is the k-th extreme point, $1 \le k < M \times N$, $b_m$, $b_n$ are position coordinate values of the k-th extreme point, $1 \le m \le M$, $1 \le n \le N$.

Specifically, the first threshold value, the second threshold value, and the third threshold value may be set to be equal, or partially or totally different from each other, depending on the field debugging effect.

Step D: obtaining second correction matrices of the three primary colors from the first correction matrices of the three primary colors, so as to further correct the first correction matrices of the three primary colors.

The step D specifically includes a step of: obtaining the second correction matrices $R_2$, $G_2$ and $B_2$ of the three primary colors by respectively multiplying the first correction matrices $R_1$, $G_1$ and $B_1$ of the three primary colors by an adjustment factor. Optionally, the adjustment factor is chosen to be −1.

In this step, the elements in the first correction matrices $R_1$, $G_1$ and $B_1$ are negated, so as to subsequently construct compensation matrices for performing a compensation by means of directly adding it to the grayscale values of the three primary colors of the display panel. The compensation mode is simple to do and requires no other complicated algorithms and processing circuits.

In the embodiment, the step D is scheduled to be performed after the step C. But in other embodiments of the present disclosure, the step D may also be scheduled to be performed before the step C or at the same time of the step C, without affecting the implementation of the present disclosure.

Step E: extracting a third correction matrix of each primary color from the second correction matrix of the primary color based on a position coordinate of an extreme point of the first correction matrix of the primary color, and forming a third correction matrix group of the primary color from third correction matrices obtained on the basis of the position coordinates of all extreme points of the first correction matrix of the primary color.

The step E specifically includes a step of: selecting sub-matrices of the second correction matrix $R_2$ of the R primary color centered on elements having the position coordinates $(r_m, r_n)_i$ as the third correction matrices $R_{3i}$ of the R primary color to constitute the third correction matrix group $R_{3I}$ of the R primary color; selecting sub-matrices of the second correction matrix $G_2$ of the G primary color centered on elements having the position coordinates $(g_m, g_n)_j$ as the third correction matrices $G_{3j}$ of the G primary color to constitute the third correction matrix group $G_{3J}$ of the G primary color; selecting sub-matrices of the second correction matrix $B_2$ of the B primary color centered on elements having the position coordinates $(b_m, b_n)_k$ as the third correction matrices $B_{3k}$ of the B primary color to constitute the third correction matrix group $B_{3K}$ of the B primary color.

Optionally, the step of selecting sub-matrices of the second correction matrix $R_2$ of the R primary color centered on elements having the position coordinates $(r_m, r_n)_i$ as the third correction matrices $R_{3i}$ of the R primary color to constitute the third correction matrix group $R_{3I}$ of the R primary color specifically includes a step of:

selecting 2W−1 order sub-matrices of the second correction matrix $(R_2)$ formed by extension as the third correction matrices $R_{3i}$ of the R primary color, wherein the 2W−1 order sub-matrix is formed by using the element having the position coordinate $(r_m, r_n)_i$ as a center, and upwardly and downwardly extending by W−1 rows in a row direction of the second correction matrix $R_2$ of the R primary color, and extending towards the left and right by W−1 columns in a column direction of the second correction matrix $R_2$ of the R primary color, wherein once a distance (or the number of rows or columns) between the position coordinates $(r_m, r_n)_i$ and an edge row or column of the second correction matrix $R_2$ of the R primary color is less than W−1, then the sub-matrices formed by extending to the edge rows or columns in the row or column direction of the second correction matrix $R_2$ of the R primary color are selected as the third correction matrices $R_{3i}$ of the R primary color, all the selected third correction matrices $R_{3I}$ of the R primary color centered on the element having the position coordinate $(r_m, r_n)_i$ constitute the third correction matrix group $R_{3I}$ of the R primary color.

Specifically $20 \le W \le 30$, the value thereof may be adjusted depending on the field debugging effect. the values W of the rows or the columns may be equal to each other, or different from each other.

The above steps do not need to recognize the specific shape of the mura. The third correction matrix formed by the extension corresponds to a rectangular area of the display panel centered on the extreme point, then the compensation values of the rectangular area are obtained, thus the method is simple and fast, and requires no other complicated algorithms and processing circuits, and can achieve a better compensation effect.

The step of selecting sub-matrices of the second correction matrix $G_2$ of the G primary color centered on elements having the position coordinates $(g_m, g_n)_j$ as the third correction matrices $G_{3j}$ of the G primary color to constitute the third correction matrix group $G_{3J}$ of the G primary color and the step of selecting sub-matrices of the second correction matrix $B_2$ of the B primary color centered on elements having the position coordinates $(b_m, b_n)_k$ as the third correction matrices $B_{3k}$ of the B primary color to constitute the third correction matrix group $B_{3K}$ of the B primary color are similar to the step of selecting sub-matrices of the second correction matrix $R_2$ of the R primary color centered on elements having the position coordinates $(r_m, r_n)_i$ as the third correction matrices $R_{3i}$ of the R primary color to constitute the third correction matrix group $R_{3I}$ of the R primary color.

Step F: obtaining a compensation matrix of each primary color from one third correction matrix in the third correction matrix group of the each primary color; forming a compensation matrix group of the primary color from the compensation matrices of the primary color obtained from all the third correction matrices in the third correction matrix group of the primary color, wherein elements of the compensation matrices of the primary color are mura compensation values of the primary color of the display panel.

The step F specifically includes a step of:

obtaining the compensation matrices $R_{4i}$ of the R primary color by multiplying the third correction matrices $R_{3i}$ in the third correction matrix group $R_{3I}$ of the R primary color by a first compensation factor $U_r$, to constitute the compensation matrix group $R_{4I}$ of the R primary color; obtaining the compensation matrices $G_{4j}$ of the G primary color by multiplying the third correction matrices $G_{3j}$ in the third correction matrix group $G_{3J}$ of the G primary color by a second compensation factor $U_g$, to constitute the compensation matrix group $G_{4J}$ of the G primary color; obtaining the compensation matrices $B_{4k}$ of the B primary color by multiplying the third correction matrices $B_{3k}$ in the third correction matrix group $B_{3K}$ of the B primary color by a third compensation factor $U_b$, to constitute the compensation matrix group $B_{4K}$ of the B primary color.

The position of the element of the compensation matrix $R_{4i}$ in the corresponding second correction matrix $R_2$ corresponds to the pixel of the display panel in this position, and the value of the element of the compensation matrix $R_{4i}$ is the mura compensation value of the R primary color of the pixel. The position of the element of the compensation matrix $G_{4i}$ in the corresponding second correction matrix $G_2$ corresponds to the pixel of the display panel in this position, and the value of the element of the compensation matrix $G_{4i}$ is the mura compensation value of the G primary color of the pixel. The position of the element of the compensation matrix $B_{4i}$ in the corresponding second correction matrix $B_2$ corresponds to the pixel of the display panel in this position, and the value of the element of the compensation matrix $B_{4i}$ is the mura compensation value of the B primary color of the pixel.

Optionally, the first compensation factor $U_r$, the second compensation factor $U_g$ and the third compensation factor $U_b$ satisfy a condition of $0.5 \leq U_r, U_g, U_b \leq 1.5$, and they may be set to be equal, or partially or totally different from each other, depending on the field debugging effect.

The image of the detection picture obtained by photographing generally has a grayscale value derivation, but such derivation may be reduced or even eliminated by using the above compensation factors, thereby improving the precision of the compensation values and optimizing the compensation effect.

In view of the above, in the method for obtaining the mura compensation value according to the first embodiment of the present disclosure, the gray detection values of the RGB three primary colors are extracted from the pixels of the image of the detection picture, and the compensation matrices are respectively generated for the gray detection values of the RGB three primary colors. Therefore, the compensation mode is more fine, the compensation precision and accuracy are higher. Furthermore, the method for obtaining the mura compensation value according to the first embodiment of the present disclosure is not implemented to all the pixels having deviations of grayscale values, but only to the pixels having deviations greater than a certain threshold, therefore the data amount of the generated compensation data is relatively small, the calculation speed is fast and the algorithm complexity is reduced, while improving the compensation precision.

According to the method for obtaining the mura compensation value according to the first embodiment of the present disclosure, after the compensation matrix group is obtained, the compensation matrix group may be stored in a memory of a control circuit or a driving circuit of the display panel. When the display panel performs an image display, the control circuit or the driving circuit reads the stored compensation matrix stored in the memory in advance from the memory, and accumulates the values of the elements in the compensation matrix to the grayscale values of the RGB three primary colors of the respective corresponding pixels, and displays the compensated grayscale values of the RGB three primary colors, thereby the mura of the display panel may be eliminated, the display effect of the display panel may be improved and the product yield may be increased.

Figure 4:
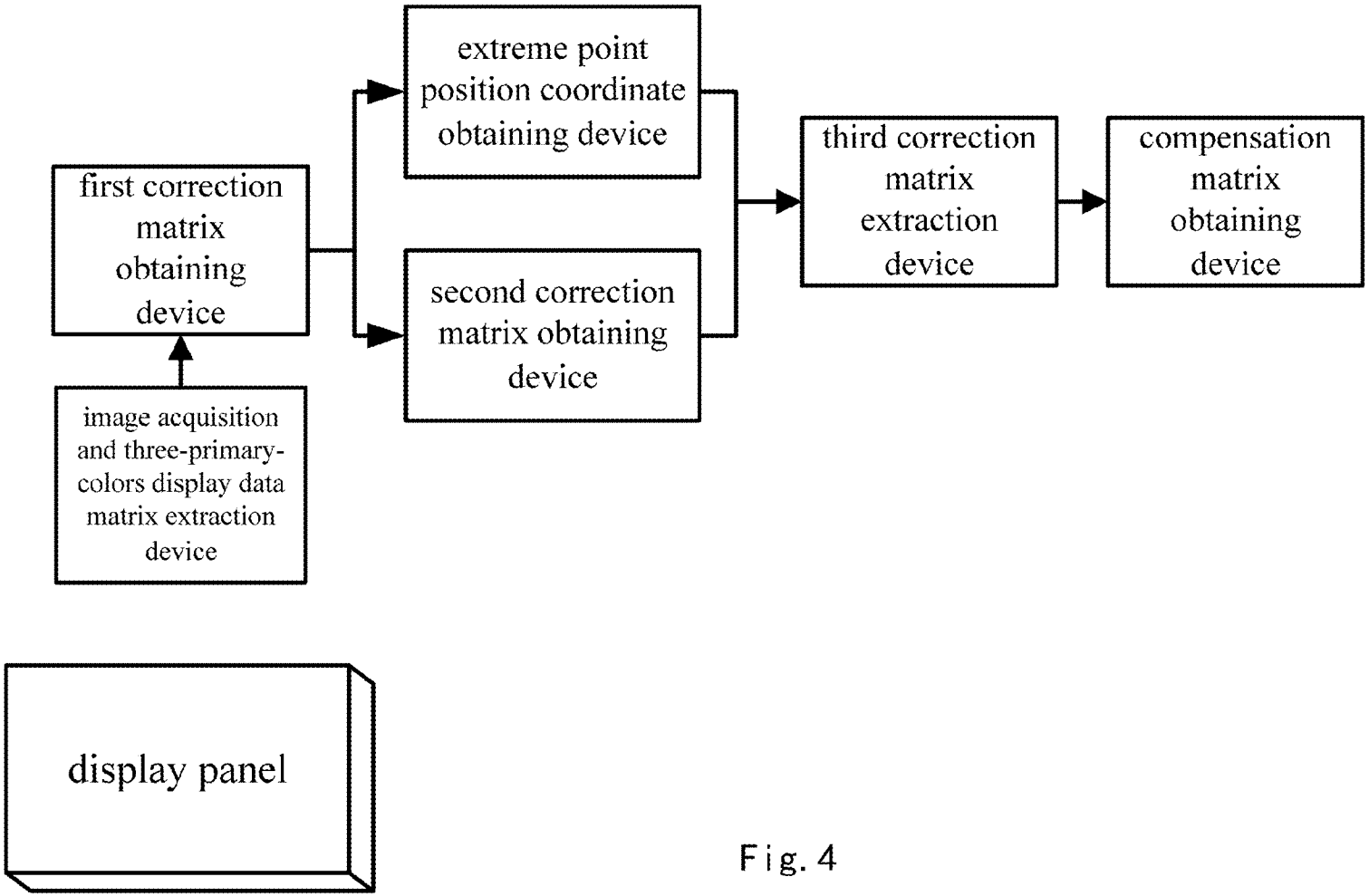
FIG. 4 is a schematic view of a device for obtaining a mura compensation value according to a second embodiment of the present disclosure.

As shown in FIG. 4, there is provided a device for obtaining a mura compensation value in a second embodiment of the present disclosure, the device is used for implementing the method for obtaining the mura compensation value according to the above first embodiment. The device includes: an image acquisition and three-primary-colors display data matrix extraction device, a first correction matrix obtaining device, an extreme point position coordinate obtaining device, a second correction matrix obtaining device, a third correction matrix extraction device and a compensation matrix obtaining device.

The image acquisition and three-primary-colors display data matrix extraction device is configured for obtaining an image of a detection picture displayed on a display panel and extracting display data matrices of three primary colors from the image of the detection picture.

The grayscale values are selected as the display data, and a display panel with a resolution of M×N is selected to display the detection picture, wherein the grayscale values of RGB three primary colors of all the pixels of the detection picture are set or predetermined gray values, i.e., the detection picture is a picture of pure color gray scale.

The image acquisition and three-primary-colors display data matrix extraction device can adopt a CCD camera or video camera to photograph the detection picture, so as to obtain the image of the detection picture. The image acquisition and three-primary-colors display data matrix extraction device extracts the gray detection values of the RGB three primary colors for each pixel of the image of the detection picture, and the grayscale value matrices $R_0$, $G_0$ and $B_0$ of the three primary colors is formed from the gray detection values of R primary color, the gray detection values of G primary color, the gray detection values of B primary color for all the pixels, respectively.

The first correction matrix obtaining device is configured:

for constructing a standard matrix and subtracting the standard matrix from the display data matrices of the three primary colors to obtain first correction matrices of the three primary colors, so as to correct the display data matrices of the three primary colors; and to construct a two dimensional standard matrix of M×N, all element values of which are the set grayscale values, and the grayscale value matrices $R_0$, $G_0$ and $B_0$ of the three primary colors respectively subtract the two dimensional standard matrix to obtain the first correction matrices $R_1$, $G_1$ and $B_1$ of the three primary colors.

The extreme point position coordinate obtaining device is configured for obtaining position coordinates of extreme points of the first correction matrices of the three primary colors, wherein the first correction matrix of each primary color has one or more position coordinates of extreme points.

The extreme point position coordinate obtaining device is configured to:

find out peak points of the first correction matrices $R_1$, $G_1$ and $B_1$ of the three primary colors;

select the peak points of the first correction matrices $R_1$, $G_1$ and $B_1$ of the three primary colors, absolute values of which are greater than a threshold value, as the extreme points of the first correction matrices $R_1$, $G_1$ and $B_1$, and obtain the position coordinates of extreme points of the first correction matrices $R_1$, $G_1$ and $B_1$ of the three primary colors;

set a first threshold value, and select the peak points of the first correction matrix $R_1$ of the R primary color, the absolute values of which are greater than the first threshold value, as the extreme points of the first correction matrix $R_1$ of the R primary color, to obtain the position coordinates $(r_m, r_n)_i$ of extreme points of the first correction matrix $R_1$ of the R primary color, wherein i is the i-th extreme point, $1 \le i < M \times N$, $r_m$, $r_n$ are position coordinate values of the i-th extreme point, $1 \le m \le M$, $1 \le n \le N$;

set a second threshold value, and select the peak points of the first correction matrix $G_1$ of the G primary color, the absolute values of which are greater than the second threshold value, as the extreme points of the first correction matrix $G_1$ of the G primary color, to obtain the position coordinates $(g_m, g_n)_j$ of extreme points of the first correction matrix $G_1$ of the G primary color, wherein j is the j-th extreme point, $1 \le j < M \times N$, $g_m$, $g_n$ are position coordinate values of the j-th extreme point, $1 \le m \le M$, $1 \le n \le N$; and set a third threshold value, and select the peak points of the first correction matrix $B_1$ of the B primary color, the absolute values of which are greater than the third threshold value, as the extreme points of the first correction matrix $B_1$ of the B primary color, to obtain the position coordinates $(b_m, b_n)_k$ of extreme points of the first correction matrix $B_1$ of the B primary color, wherein k is the k-th extreme point, $1 \le k < M \times N$, $b_m$, $b_n$ are position coordinate values of the k-th extreme point, $1 \le m \le M$, $1 \le n \le N$.

The second correction matrix obtaining device is configured for obtaining second correction matrices of the three primary colors from the first correction matrices of the three primary colors, so as to further correct the first correction matrices of the three primary colors.

The third correction matrix extraction device is configured for extracting a third correction matrix of each primary color from the second correction matrix of the each primary color based on position coordinates of an extreme point of the first correction matrix of the primary color and forming a third correction matrix group of the primary color from third correction matrices extracted based on the position coordinates of all extreme points of the first correction matrix of the primary color.

The third correction matrix extraction device is configured:

to select sub-matrices of the second correction matrix $R_2$ of the R primary color centered on elements of the position coordinates $(r_m, r_n)_i$ as the third correction matrices $R_{3i}$ of the R primary color to constitute the third correction matrix group $R_{3I}$ of the R primary color;

to select sub-matrices of the second correction matrix $G_2$ of the G primary color centered on elements of the position coordinates $(g_m, g_n)_j$ as the third correction matrices $G_{3j}$ of the G primary color to constitute the third correction matrix group $G_{3J}$ of the G primary color; and to select sub-matrices of the second correction matrix $B_2$ of the B primary color centered on elements of the position coordinates $(b_m, b_n)_k$ as the third correction matrices $B_{3k}$ of the B primary color to constitute the third correction matrix group $B_{3K}$ of the B primary color.

The compensation matrix obtaining device is configured for obtaining a compensation matrix of each primary color from one third correction matrix in the third correction matrix group of the each primary color and forming a compensation matrix group of the primary color from the compensation matrices of the primary color obtained from all the third correction matrices in the third correction matrix group of the primary color, wherein elements of the compensation matrices of the primary color are mura compensation values of the primary color of the display panel.

The compensation matrix obtaining device is configured to obtain the compensation matrices $R_{4i}$ of the R primary color by multiplying the third correction matrices $R_{3i}$ in the third correction matrix group $R_{3I}$ of the R primary color by a first compensation factor $U_r$, to constitute the compensation matrix group $R_{4I}$ of the R primary color; to obtain the compensation matrices $G_{4j}$ of the G primary color by multiplying the third correction matrices $G_{3j}$ in the third correction matrix group $G_{3J}$ of the G primary color by a second compensation factor $U_g$, to constitute the compensation matrix group $G_{4J}$ of the G primary color; and to obtain the compensation matrices $B_{ok}$ of the B primary color by multiplying the third correction matrices $B_{3k}$ in the third correction matrix group $B_{3K}$ of the B primary color by a third compensation factor $U_b$, to constitute the compensation matrix group $B_{4K}$ of the B primary color.

There is provided a display panel in the third embodiment of the present disclosure. The display panel includes a driver and a storage device, wherein the compensation matrix group obtained by the device for obtaining the mura compensation value according to the above embodiments is stored in the storage device, and the driver is configured to perform a mura compensation to the display panel using the compensation matrices in the compensation matrix group.

In view of the above technical solutions, the method for obtaining a mura compensation value, the device for obtaining a mura compensation value and the display panel in the present disclosure have the following advantageous effects:

The grayscale values of the RGB three primary colors are extracted from the pixels of the image of the detection picture, and the compensation matrices are respectively generated for the grayscale values of the RGB three primary colors, therefore the compensation mode is finer, and the compensation precision and accuracy are higher.

The compensation is not implemented to all the pixels having deviations of grayscale values, but only to the pixels having deviations greater than a certain threshold, therefore the data amount of the generated compensation data is relatively small, the calculation speed is fast and the algorithm complexity is reduced, while improving the compensation precision.

The compensation matrices are used to compensate the grayscale values of the display panel, thereby the mura of the display panel may be eliminated, the display effect of the display panel may be improved and the product yield may be increased.

Hereto, the embodiments of the present disclosure have been described in detail with reference to the accompanying drawings. Based on the above description, the method for obtaining a mura compensation value, the device for obtaining a mura compensation value, and the display panel according to the present disclosure may be clearly understood by those skilled in the art.

It should be noted that the embodiments which are not shown or described in the drawings or the text of the specification may be known to those skilled in the art, therefore they are not described in detail. Furthermore, the above-described definitions of the elements are not limited to the various specific structures, shapes or modes mentioned in the embodiments, and they may be changed or replaced by those skilled in the art.

In addition, the directional terms mentioned in the embodiments, such as "up", "down", "front", "rear", "left", "right" and the like are in connection with the drawings, but are not intended to limit the scope of protection of the present disclosure. In the method embodiment, the order of the above steps is not limited to those listed above and may be varied or rearranged according to the desired design, unless the order is particularly described or must be performed in sequence. Moreover, the embodiments described above may be used in combination with each other, or may be used in combination with other embodiments in view of design and reliability, that is to say, the technical features in the different embodiments may be freely combined to form more embodiments.

The objects, technical solutions and advantages of the present disclosure have been described in greater detail with reference to the above described specific embodiments. It should be understood that the above described embodiments are exemplary, but not intended to limit the present disclosure. Any modifications, equivalent substitutions, improvements made within the spirits and principles of the present disclosure are intended to be covered within the protection scope of the present disclosure.

What is claimed is:

1. A method for obtaining a mura compensation value, comprising:

step A: obtaining an image of a detection picture displayed on a display panel, and extracting display data matrices of three primary colors from the image of the detection picture;

step B: constructing a standard matrix, and subtracting the standard matrix from the display data matrices of the three primary colors to obtain first correction matrices of the three primary colors, so as to correct the display data matrices of the three primary colors;

step C: obtaining position coordinates of extreme points of the first correction matrices of the three primary colors, wherein the first correction matrix of each primary color has one or more position coordinates of the extreme points;

step D: obtaining second correction matrices of the three primary colors from the first correction matrices of the three primary colors, so as to further correct the first correction matrices of the three primary colors;

step E: extracting a third correction matrix of each primary color from the second correction matrix of the primary color based on position coordinates of an extreme point of the first correction matrix of the each primary color, and forming a third correction matrix group of the primary color from third correction matrices extracted based on the position coordinates of all extreme points of the first correction matrix of the primary color; and step F: obtaining a compensation matrix of each primary color from one third correction matrix in the third correction matrix group of the each primary color; forming a compensation matrix group of the primary color from the compensation matrices of the primary color obtained from all the third correction matrices in the third correction matrix group of the primary color, wherein elements of the compensation matrices of the primary color are mura compensation values of the primary color of the display panel.

2. The method according to claim 1, wherein the step A comprises:

sub-step A1: selecting grayscale values as display data, and selecting a display panel with a resolution of M×N to display the detection picture, wherein the grayscale values of RGB three primary colors of all the pixels of the detection picture are set grayscale values, and wherein M and N are positive integers;

sub-step A2: photographing the detection picture to obtain the image of the detection picture; and sub-step A3: extracting grayscale detection values of the RGB three primary colors for each pixel of the image of the detection picture, and forming grayscale value matrices ($R_0$, $G_0$ and $B_0$) of the three primary colors from the grayscale detection values of R primary color, the grayscale detection values of G primary color, the grayscale detection values of B primary color for all the pixels, respectively.

3. The method according to claim 2, wherein the step B comprises:

constructing a two dimensional standard matrix of M×N, all element values of which are the set grayscale values in the sub-step A1, and respectively subtracting the two dimensional standard matrix from the grayscale value matrices ($R_0$, $G_0$ and $B_0$) of the three primary colors to obtain the first correction matrices ($R_1$, $G_1$ and $B_1$) of the three primary colors.

4. The method according to claim 3, wherein the step C comprises:

sub-step C1: finding out peak points of the first correction matrices ($R_1$, $G_1$ and $B_1$) of the three primary colors wherein the peak points are local maximum elements and local minimum elements in the first correction matrices ($R_1$, $G_1$ and $B_1$) of the three primary colors;

sub-step C2: selecting the peak points of the first correction matrices ($R_1$, $G_1$ and $B_1$) of the three primary colors, absolute values of which are greater than a threshold value, as the extreme points of the first correction matrices ($R_1$, $G_1$ and $B_1$), and obtaining the position coordinates of the extreme points of the first correction matrices ($R_1$, $G_1$ and $B_1$) of the three primary colors.

5. The method according to claim 4, wherein the sub-step C2 comprises:

setting a first threshold value, and selecting the peak points of the first correction matrix ($R_1$) of the R primary color, the absolute values of which are greater than the first threshold value, as the extreme points of the first correction matrix ($R_1$) of the R primary color, to obtain the position coordinates $(r_m, r_n)_i$ of extreme points of the first correction matrix ($R_1$) of the R primary color, wherein i is the i-th extreme point, $1 \le i \le M \times N$, $r_m$, $r_n$ are position coordinate values of the i-th extreme point, $1 \le m \le M$, $1 \le n \le N$;

setting a second threshold value and a third threshold value, and respectively processing the first correction matrix ($G_1$) of the G primary color and the first correction matrix ($B_1$) of the B primary color in the same manner as the first correction matrix ($R_1$) of the R primary color, to obtain the position coordinates $(g_m, g_n)_j$ of extreme points of the first correction matrix ($G_1$) of the G primary color and the position coordinates $(b_m, b_n)_k$ of extreme points of the first correction matrix ($B_1$) of the B primary color, wherein j is the j-th extreme point, k is the k-th extreme point, $1 \le j, k < M \times N$, $g_m$, $g_n$ are position coordinate values of the j-th extreme point, $b_m$, $b_n$ are position coordinate values of the k-th extreme point.

6. The method according to claim 5, wherein the step D comprises:

obtaining the second correction matrices ($R_2$, $G_2$ and $B_2$) of the three primary colors by respectively multiplying the first correction matrices ($R_1$, $G_1$ and $B_1$) of the three primary colors by an adjustment factor.

7. The method according to claim 6, wherein the step E comprises:

selecting sub-matrices of the second correction matrix ($R_2$) of the R primary color centered on elements of the position coordinates $(r_m, r_n)_i$ as the third correction matrices ($R_{3i}$) of the R primary color to constitute the third correction matrix group ($R_{3I}$) of the R primary color;

selecting sub-matrices of the second correction matrix ($G_2$) of the G primary color centered on elements of the position coordinates $(g_m, g_n)_j$ as the third correction matrices ($G_{3j}$) of the G primary color to constitute the third correction matrix group ($G_{3J}$) of the G primary color; and selecting sub-matrices of the second correction matrix ($B_2$) of the B primary color centered on elements of the position coordinates $(b_m, b_n)_k$ as the third correction matrices ($B_{3k}$) of the B primary color to constitute the third correction matrix group ($B_{3K}$) of the B primary color.

8. The method according to claim 7, wherein the step of selecting sub-matrices of the second correction matrix ($R_2$) of the R primary color centered on elements of the position coordinates $(r_m, r_n)_i$ as the third correction matrices ($R_{3i}$) of the R primary color to constitute the third correction matrix group ($R_{3I}$) of the R primary color comprises:

selecting sub-matrices of 2W−1 order of the second correction matrix ($R_2$) formed by extension as the third correction matrices ($R_{3i}$) of the R primary color, wherein the sub-matrices of 2W−1 order are formed by using the elements of the position coordinates $(r_m, r_n)_I$ as centers, and upwardly and downwardly extending by W−1 rows in a row direction of the second correction matrix ($R_2$) of the R primary color, and extending towards the left by W−1 columns and towards the right by W−1 columns in a column direction of the second correction matrix ($R_2$) of the R primary color, wherein if a distance between the position coordinates $(r_m,r_n)_i$ and an edge row or column of the second correction matrix ($R_2$) of the R primary color is less than W−1, then the sub-matrices formed by extending to the edge row or column in the row or column direction of the second correction matrix ($R_2$) of the R primary color are selected as the third correction matrices ($R_{3i}$) of the R primary color, all the selected third correction matrices ($R_{3i}$) of the R primary color centered on the elements of the position coordinates $(r_m, r_n)_i$ constitute the third correction matrix group ($R_{3I}$) of the R primary color; and processing the second correction matrix ($G_2$) of the G primary color and the second correction matrix ($B_2$) of the B primary color in the same manner as the second correction matrix ($R_2$) of the R primary color, to constitute the third correction matrix group ($G_{3J}$) of the G primary color and the third correction matrix group ($B_{3K}$) of the B primary color.

9. The method according to claim 7, wherein the step F comprises:

obtaining the compensation matrices ($R_{4i}$) of the R primary color by multiplying the third correction matrices ($R_{3i}$) of the R primary color in the third correction matrix group ($R_{3I}$) of the R primary color by a first compensation factor $U_r$, to constitute the compensation matrix group ($R_{4I}$) of the R primary color;

obtaining the compensation matrices ($G_{4j}$) of the G primary color by multiplying the third correction matrices ($G_{3j}$) of the G primary color in the third correction matrix group ($G_{3J}$) of the G primary color by a second compensation factor $U_g$, to constitute the compensation matrix group ($G_{4J}$) of the G primary color; and obtaining the compensation matrices ($B_{4k}$) of the B primary color by multiplying the third correction matrices ($B_{3k}$) of the B primary color in the third correction matrix group ($B_{3K}$) of the B primary color by a third compensation factor $U_b$, to constitute the compensation matrix group ($B_{4K}$) of the B primary color.

10. The method according to claim 9, wherein the first compensation factor $U_r$, the second compensation factor $U_g$ and the third compensation factor $U_b$ satisfy a range of $0.5 \le U_r, U_g, U_b \le 1.5$.

11. A device for obtaining a mura compensation value, comprising:

an image acquisition and three-primary-colors display data matrix extraction device, configured for obtaining an image of a detection picture displayed on a display panel and extracting display data matrices of three primary colors from the image of the detection picture;

a first correction matrix obtaining device, configured for constructing a standard matrix and subtracting the standard matrix from the display data matrices of the three primary colors to obtain first correction matrices of the three primary colors, so as to correct the display data matrices of the three primary colors;

an extreme point position coordinate obtaining device, configured for obtaining position coordinates of extreme points of the first correction matrices of the three primary colors, wherein the first correction matrix of each primary color has one or more position coordinates of extreme points;

a second correction matrix obtaining device, configured for obtaining second correction matrices of the three primary colors from the first correction matrices of the three primary colors, so as to further correct the first correction matrices of the three primary colors;

a third correction matrix extraction device, configured for extracting a third correction matrix of each primary color from the second correction matrix of the each primary color based on position coordinates of an extreme point of the first correction matrix of the each primary color and forming a third correction matrix group of the primary color from third correction matrices extracted based on the position coordinates of all extreme points of the first correction matrix of the primary color; and a compensation matrix obtaining device, configured for obtaining a compensation matrix of each primary color from one third correction matrix in the third correction matrix group of the each primary color and forming a compensation matrix group of the primary color from the compensation matrices of the primary color obtained from all the third correction matrices in the third correction matrix group of the primary color, wherein elements of the compensation matrices of the primary color are mura compensation values of the primary color of the display panel.

12. The device for obtaining a mura compensation value according to claim 11, wherein, grayscale values are selected as display data, a display panel with a resolution of M×N is selected to display the detection picture, and the grayscale values of RGB three primary colors of all the pixels of the detection picture are set grayscale values, wherein M and N are positive integers;

the detection picture is photographed by the image acquisition and three-primary-colors display data matrix extraction device to obtain the image of the detection picture; and grayscale detection values of the RGB three primary colors are extracted for each pixel of the image of the detection picture, grayscale value matrices ($R_0$, $G_0$ and $B_0$) of the three primary colors are formed from the grayscale detection values of R primary color, the grayscale detection values of G primary color, the grayscale detection values of B primary color for all the pixels, respectively.

13. The device for obtaining a mura compensation value according to claim 12, wherein the first correction matrix obtaining device is configured to construct a two dimensional standard matrix of M×N, element values of which all are the set grayscale values, and respectively subtract the two dimensional standard matrix from the grayscale value matrices ($R_0$, $G_0$ and $B_0$) of the three primary colors to obtain the first correction matrices ($R_1$, $G_1$ and $B_1$) of the three primary colors.

14. The device for obtaining a mura compensation value according to claim 13, wherein the extreme point position coordinate obtaining device is configured:

to find out peak points of the first correction matrices ($R_1$, $G_1$ and $B_1$) of the three primary colors, wherein the peak points are local maximum elements and local minimum elements in the first correction matrices ($R_1$, $G_1$ and $B_1$) of the three primary colors; and to select the peak points of the first correction matrices ($R_1$, $G_1$ and $B_i$) of the three primary colors, absolute values of which are greater than a threshold value, as the extreme points of the first correction matrices ($R_1$, $G_1$ and $B_1$), and obtain the position coordinates of extreme points of the first correction matrices ($R_1$, $G_1$ and $B_1$) of the three primary colors.

15. The device for obtaining a mura compensation value according to claim 14, wherein the extreme point position coordinate obtaining device is configured:

to set a first threshold value, and select the peak points of the first correction matrix ($R_1$) of the R primary color, the absolute values of which are greater than the first threshold value, as the extreme points of the first correction matrix ($R_1$) of the R primary color, to obtain the position coordinates $(r_m, r_n)_i$ of extreme points of the first correction matrix ($R_1$) of the R primary color, wherein i is the i-th extreme point, $1 \le i < M \times N$, $r_m$, $r_n$ are position coordinate values of the i-th extreme point, $1 \le m \le M$, $1 \le n \le N$; and to set a second threshold value and a third threshold value, respectively processing the first correction matrix ($G_1$) of the G primary color and the first correction matrix ($B_1$) of the B primary color in the same manner as the first correction matrix ($R_1$) of the R primary color, to obtain the position coordinates $(g_m, g_n)_j$ of extreme points of the first correction matrix ($G_1$) of the G primary color and the position coordinates $(b_m, b_n)_k$ of extreme points of the first correction matrix ($B_1$) of the B primary color, wherein j is the j-th extreme point, k is the k-th extreme point, $1 \le j$, $k < M \times N$, $g_m$, $g_n$ are position coordinate values of the j-th extreme point, $b_m$, $b_n$, are position coordinate values of the k-th extreme point.

16. The device for obtaining a mura compensation value according to claim 15, wherein the second correction matrix obtaining device is configured to obtain the second correction matrices ($R_2$, $G_2$ and $B_2$) of the three primary colors by respectively multiplying the first correction matrices ($R_1$, $G_1$ and $B_1$) of the three primary colors by an adjustment factor.

17. The device for obtaining a mura compensation value according to claim 16, wherein the third correction matrix extraction device is configured:

to select sub-matrices of the second correction matrix ($R_2$) of the R primary color centered on elements of the position coordinates $(r_m, r_n)_i$ as the third correction matrices ($R_{3i}$) of the R primary color to constitute the third correction matrix group ($R_{3I}$) of the R primary color;

to select sub-matrices of the second correction matrix ($G_2$) of the G primary color centered on elements of the position coordinates $(g_m, g_n)_j$ as the third correction matrices ($G_{3j}$) of the G primary color to constitute the third correction matrix group ($G_{3J}$) of the G primary color; and to select sub-matrices of the second correction matrix ($B_2$) of the B primary color centered on elements of the position coordinates $(b_m, b_n)_k$ as the third correction matrices ($B_{3k}$) of the B primary color to constitute the third correction matrix group ($B_{3K}$) of the B primary color.

18. The device for obtaining a mura compensation value according to claim 17, wherein the third correction matrix extraction device is configured:

to select sub-matrices of 2W−1 order of the second correction matrix ($R_2$) formed by extension as the third correction matrices ($R_{3i}$) of the R primary color, wherein the sub-matrices of 2W−1 order are formed by using the elements of the position coordinates $(r_m, r_n)_I$ as centers, and upwardly and downwardly extending by W−1 rows in a row direction of the second correction matrix ($R_2$) of the R primary color, and extending towards the left by W−1 columns and towards the right by W−1 columns in a column direction of the second correction matrix ($R_2$) of the R primary color, wherein if a distance between the position coordinates $(r_m, r_n)_i$ and an edge row or column of the second correction matrix ($R_2$) of the R primary color is less than W−1, then the sub-matrices formed by extending to the edge row or column in the row or column direction of the second correction matrix ($R_2$) of the R primary color are selected as the third correction matrices ($R_{3i}$) of the R primary color, all the selected third correction matrices ($R_{3i}$) of the R primary color centered on the elements of position coordinates $(r_m, r_n)_i$ constitute the third correction matrix group ($R_{3I}$) of the R primary color; and to process the second correction matrix ($G_2$) of the G primary color and the second correction matrix ($B_2$) of the B primary color in the same manner as the second correction matrix ($R_2$) of the R primary color, to constitute the third correction matrix group ($G_{3J}$) of the G primary color and the third correction matrix group ($B_{3K}$) of the B primary color.

19. The device for obtaining a mura compensation value according to claim 18, wherein the compensation matrix obtaining device is configured:

to obtain the compensation matrices ($R_{4i}$) of the R primary color by multiplying the third correction matrices ($R_{3i}$) of the R primary color in the third correction matrix group ($R_{3I}$) of the R primary color by a first compensation factor $U_r$, to constitute the compensation matrix group ($R_{4I}$) of the R primary color;

to obtain the compensation matrices ($G_{4i}$) of the G primary color by multiplying the third correction matrices ($G_{3j}$) of the G primary color in the third correction matrix group ($G_{3J}$) of the G primary color by a second compensation factor $U_g$, to constitute the compensation matrix group ($G_{4J}$) of the G primary color; and to obtain the compensation matrices ($B_{4k}$) of the B primary color by multiplying the third correction matrices ($B_{3k}$) of the B primary color in the third correction matrix group ($B_{3K}$) of the B primary color by a third compensation factor $U_b$, to constitute the compensation matrix group ($B_{4K}$) of the B primary color;

wherein the first compensation factor $U_r$, the second compensation factor $U_g$ and the third compensation factor $U_b$ satisfy a range of $0.5 \leq U_r, U_g, U_b \leq 1.5$.

20. A display panel, comprising a driver and a storage device, wherein the compensation matrix group obtained by the device for obtaining the mura compensation value according to claim 11 is stored in the storage device, and the driver is configured to perform mura compensation to the display panel using the compensation matrices in the compensation matrix group.

* * * * *